US007760143B2

(12) United States Patent
Wei

(10) Patent No.: US 7,760,143 B2
(45) Date of Patent: Jul. 20, 2010

(54) MULTI-FREQUENCY ANTENNA AND AN ELECTRIC DEVICE THEREOF

(75) Inventor: Shen-Pin Wei, Taipei Hsien (TW)

(73) Assignee: Wistron NeWeb Corp., Taipei Hsien (TW)

( * ) Notice: Subject to any disclaimer, the term of this patent is extended or adjusted under 35 U.S.C. 154(b) by 54 days.

(21) Appl. No.: 11/882,958

(22) Filed: Aug. 8, 2007

(65) Prior Publication Data

US 2008/0231516 A1 Sep. 25, 2008

(30) Foreign Application Priority Data

Mar. 20, 2007 (TW) ..... 96109590 A

(51) Int. Cl.
*H01Q 1/38* (2006.01)

(52) U.S. Cl. ..... 343/700 MS; 343/702

(58) Field of Classification Search ..... None
See application file for complete search history.

(56) References Cited

U.S. PATENT DOCUMENTS

| | | | | |
|---|---|---|---|---|
| 7,034,754 | B2 * | 4/2006 | Hung et al. | 343/700 MS |
| 7,289,071 | B2 * | 10/2007 | Hung et al. | 343/702 |
| 7,429,955 | B2 * | 9/2008 | Tai et al. | 343/702 |
| 2005/0168384 | A1 * | 8/2005 | Wang et al. | 343/700 MS |
| 2005/0259024 | A1 * | 11/2005 | Hung et al. | 343/770 |
| 2007/0018892 | A1 * | 1/2007 | Ku et al. | 343/700 MS |
| 2007/0030198 | A1 * | 2/2007 | Wei | 343/700 MS |
| 2007/0120753 | A1 * | 5/2007 | Hung et al. | 343/702 |
| 2007/0146216 | A1 * | 6/2007 | Wang et al. | 343/702 |
| 2007/0216582 | A1 * | 9/2007 | Cheng et al. | 343/702 |
| 2008/0001839 | A1 * | 1/2008 | Wei et al. | 343/848 |

FOREIGN PATENT DOCUMENTS

| | | |
|---|---|---|
| TW | 562257 | 11/2003 |
| TW | M299362 | 10/2006 |

* cited by examiner

*Primary Examiner*—Trinh V Dinh
(74) *Attorney, Agent, or Firm*—Muncy, Geissler, Olds & Lowe, PLLC

(57) ABSTRACT

A multi-frequency antenna is disclosed. The multi-frequency antenna is positioned on an electric device for transmitting Wi-Fi and Wimax wireless signals. The multi-frequency antenna comprises a radiating element, a grounding element and a connecting element. The radiating element comprises a first radiating area and a second radiating area, which are perpendicular to each other. The connecting element is connected to the second radiating area of the radiating element and the grounding element.

14 Claims, 9 Drawing Sheets

MULTI-FREQUENCY ANTENNA AND AN ELECTRIC DEVICE THEREOF

BACKGROUND OF THE INVENTION

1. Field of the Invention

The present invention relates to an antenna, and more particularly, to a multi-frequency antenna for transmitting Wi-Fi and WiMax wireless signals.

2. Description of the Related Art

Due to the developments in wireless communication technology, many electronic devices, such as notebooks and mobile phones, now incorporate wireless communication technologies to transmit information. Besides mobile communication devices, like notebooks and mobile phones, desktop computers can also be used to transmit signals through wireless communication technologies. To receive and transmit signals, the prior art has disclosed an antenna for electromagnetic radiation for these electronic devices.

In modern wireless communication technologies, the Wi-Fi (Wireless Fidelity) antenna is currently the most important tool for transmitting signals. Therefore the Wi-Fi antenna is built into all kinds of wireless communication products. However, due to the progress in the development of wireless communication technologies, the WiMax (Worldwide Interoperability for Microwave Access) antenna will become main stream in the future. Yet the operation frequency of the Wi-Fi antenna and the WiMax antenna are different. The Wi-Fi antenna's operation frequency is about 2.4 GHz and 5 GHz. The WiMax antenna's operation frequency is about 2.3 GHz, 3.3 GHz and 5 GHz.

Please refer to FIG. 1A. FIG. 1A shows a prior art technology disclosed in U.S. Pat. No. 6,861,986. An antenna 90 comprises a radiating element 91, a connecting element 92 and a grounding element 93. The connecting element 92 has a first end 921 and a second end 922. Furthermore, the first end 921 of the connecting element 92 is connected to the radiating element 91, and the second end 922 is connected to the grounding element 93.

Next, please refer to FIG. 1B. FIG. 1B shows the voltage standing wave ratio (VSWR) at different frequencies according to the prior art antenna 90 shown in FIG. 1A. As shown in FIG. 1B, the prior art antenna 90 only transmits at about 2.5 GHz and 5 GHz. Therefore, in the prior art a WiMax signal can only be transmitted by mounting a WiMax antenna in addition to a Wi-Fi antenna. This increases manufacturing costs and also occupies additional space within the communication products.

Thus, it is desirable to provide a multi-frequency antenna to mitigate and/or obviate the aforementioned problems.

SUMMARY OF THE INVENTION

A main objective of the present invention is to provide a multi-frequency antenna, which is capable of transmitting Wi-Fi and WiMax wireless signals.

In order to achieve the above-mentioned objective, the multi-frequency antenna comprises a radiating element, a grounding element, and a connecting element. In one embodiment of this invention, the radiating element comprises a first, second, and third radiation areas to transmit wireless communication signals. It should be understood that besides the first radiation area, the radiating element may comprise at least one radiation area. The first and the second radiation area are perpendicular to each other. In embodiments with a third radiation area, the first and the third radiation area are laterally pointing away from the second radiation area either in the same direction or in opposite directions. The grounding element may consist of a single plane or of a first plane and a second plane. It is used for grounding the multi-frequency antenna. The connecting element is used to connect the radiating element and the grounding element. There is a gap between the radiating element and the grounding element to increase the capacitance of the multi-frequency antenna. There is a feeding point on the second radiation area and a grounding point on the grounding element. Two points are connected by a radio frequency (RF) cable, and a feeding line is used to transmit a received signal to the electric device. The feeding point and the grounding point are close to each other in order to assure the current characteristic of the multi-frequency antenna. The length of the second radiation area is larger than the length of the grounding element. The length of the second radiation area is larger than or equal to the length of the first radiation area.

In another embodiment of this invention, a fourth radiating area may be perpendicularly connected to the first radiation area, and a fifth radiation area may be perpendicularly connected to the third radiation area.

With the above-mentioned structures, the multi-frequency antenna has the ability to transmit signals from 2.3 GHz to 6 GHz.

Other objects, advantages, and novel features of the invention will become more apparent from the following detailed description in conjunction with the accompanying drawings.

DETAILED DESCRIPTION OF THE PREFERRED EMBODIMENT

Figure 1A:
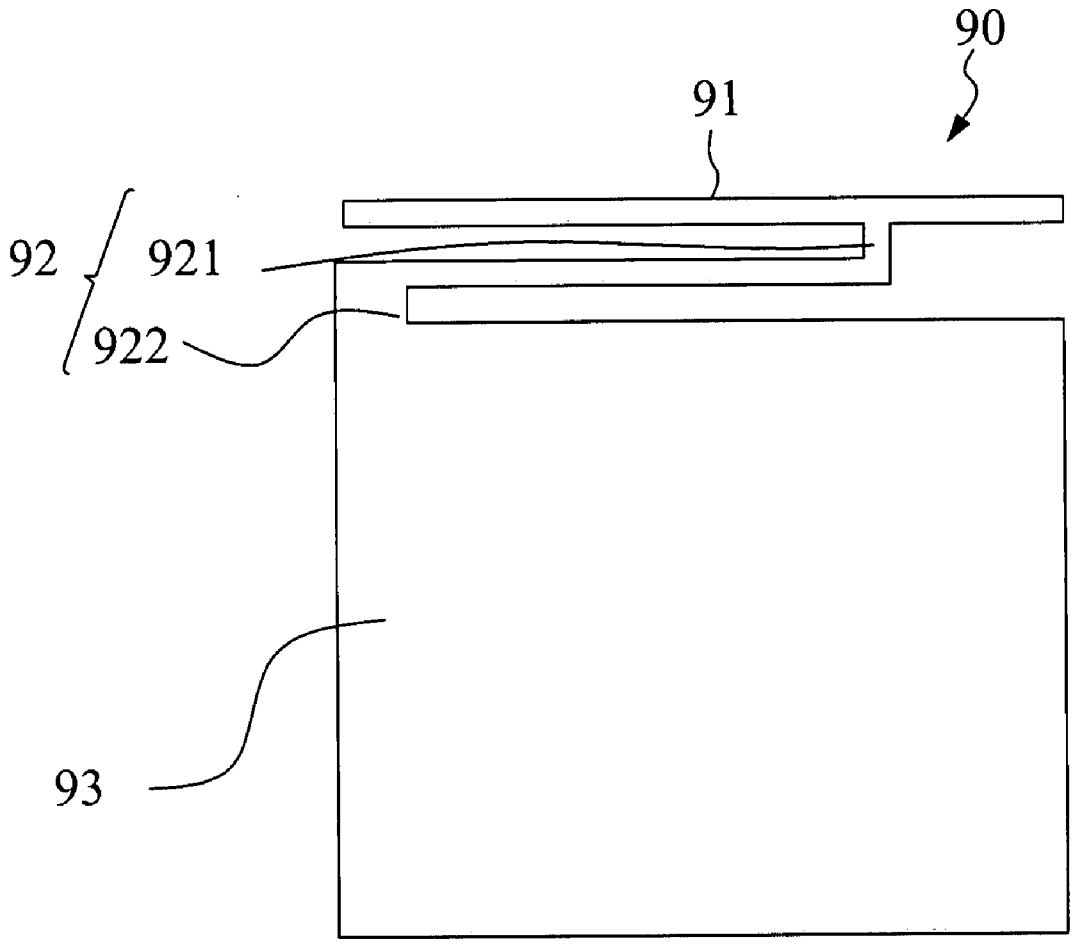
Prior art FIG. 1A
FIG. 1A illustrates a prior art antenna.
Figure 1B:
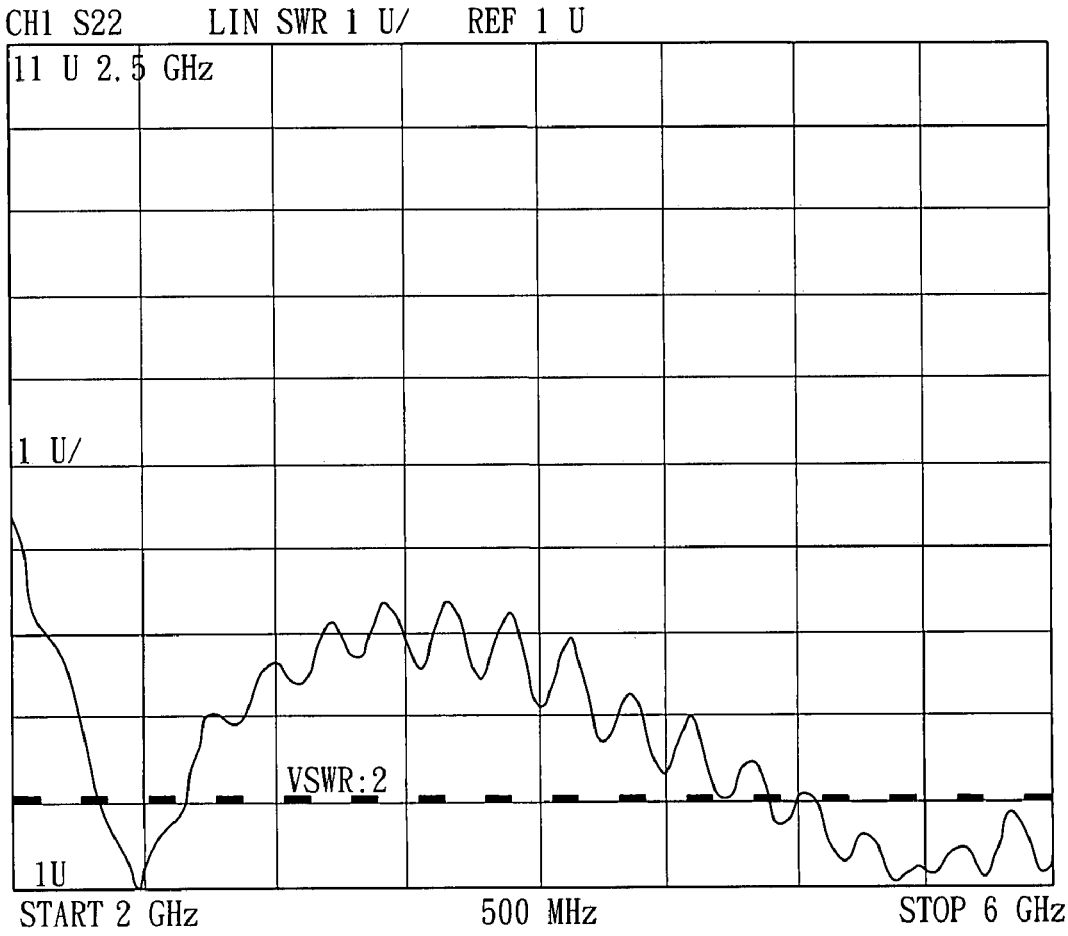
Prior art FIG. 1B
FIG. 1B shows the VSWR for different frequencies according to the prior art antenna shown in FIG. 1A.
Figure 2:
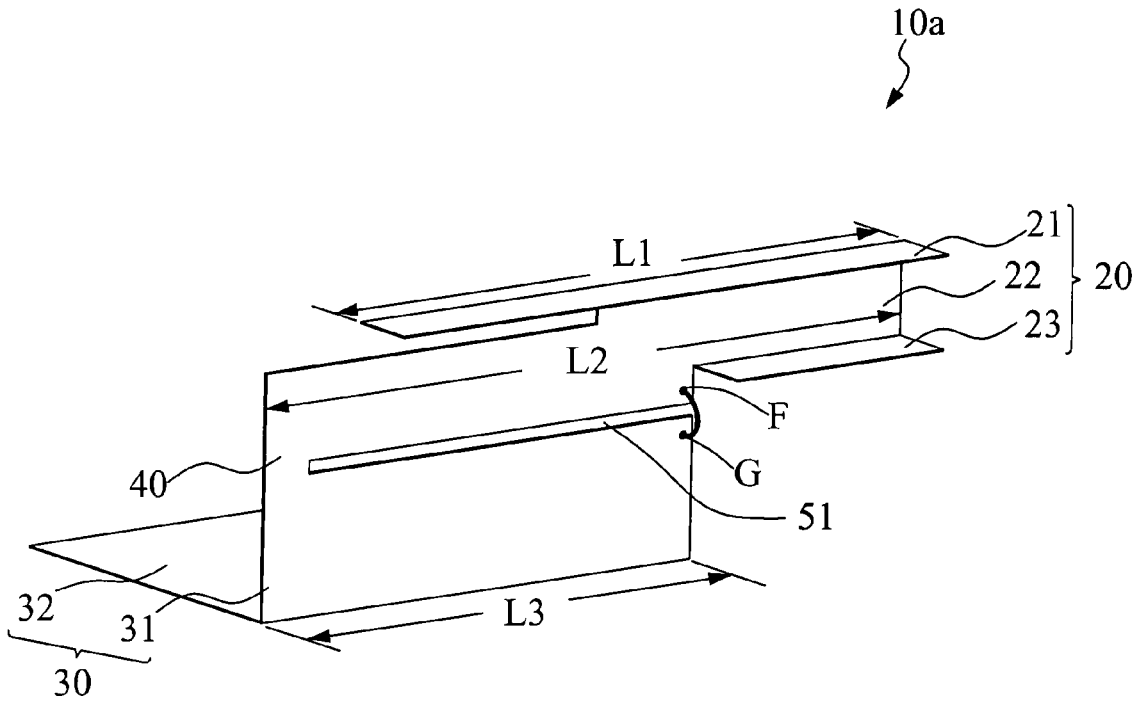
FIG. 2 is a schematic drawing of a multi-frequency antenna according to a first embodiment of the present invention.

Please refer to FIG. 2, which is a schematic drawing of a multi-frequency antenna according to the first embodiment of the present invention.

A multi-frequency antenna 10*a* of the present invention comprises a radiating element 20, a grounding element 30, and a connecting element 40. The radiating element 20 comprises a first radiation area 21, a second radiation area 22, and a third radiation area 23. The radiating element 20 is used to transmit wireless communication signals. The first radiation area 21 and the second radiation area 22 are perpendicularly adjacent to each other; the second radiation area 22 and the third radiation area 23 are also perpendicularly adjacent to each other. The first radiation area 21 and the third radiation area 23 are laterally pointing away from the second radiation area 22 in the same direction. The grounding element 30 is used for grounding in the multi-frequency antenna 10*a*. The grounding element 30 comprises a first plane 31 and a second plane 32. The first plane 31 and the second plane 32 are perpendicularly adjacent to each other. The multi-frequency antenna 10*a* may be affixed to a specific location with glue, with a clip, using a screw or by other means. The connecting element 40 is used to connect the second radiation area 22 of the radiating element 20 with the first plane 31 of the grounding element 30. There is a gap 51 between the second radiation area 22 of the radiating element 20 and the first plane 31 of the grounding element 30. The gap 51 is a slender gap and is used to increase the capacitance of the multi-frequency antenna 10*a*. The gap 51 may be a rectangular shape or may have other shapes.

Figure 8:
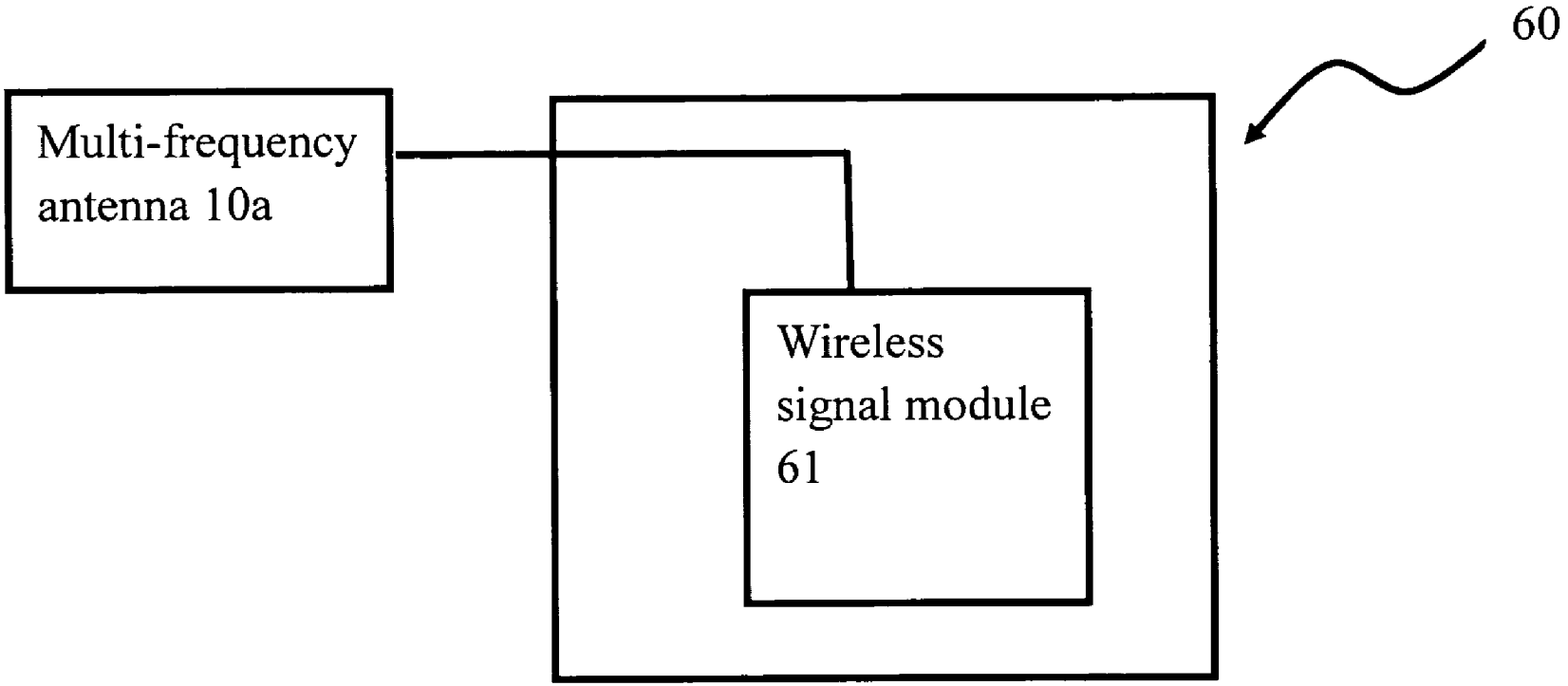
FIG. 8 is a system block diagram of the electric device according to the present invention.

There is a feeding point F on the second radiation area 22 and a grounding point G on the grounding element 30. The two points are connected via an RF cable, and a feeding line (not shown) is used to transmit the received signal to the electric device 60 (as shown in FIG. 8). The feeding point F and the grounding point G are close to each other in order to assure the current characteristic of the multi-frequency antenna 10*a*.

Moreover, in the multi-frequency antenna 10*a* of the present invention, there is a defined relation between the lengths of the grounding element 30 and of the radiating element 20, as well as between the lengths of the first radiation area 21 and the second radiation area 22. The length of the second radiation area L2 is larger than the length of the grounding element L3. The length of the second radiation area L2 is larger than or equal to the length of the first radiation area L1. As shown in FIG. 2, there is no grounding element 30 under part of the radiating element 20, that is, there is no grounding element 30 under the third radiation area 23. Since the grounding element 30 is located at the left side of the feeding point F and the grounding point G, the multi-frequency antenna 10*a* can thus be in broadband.

Figure 3:
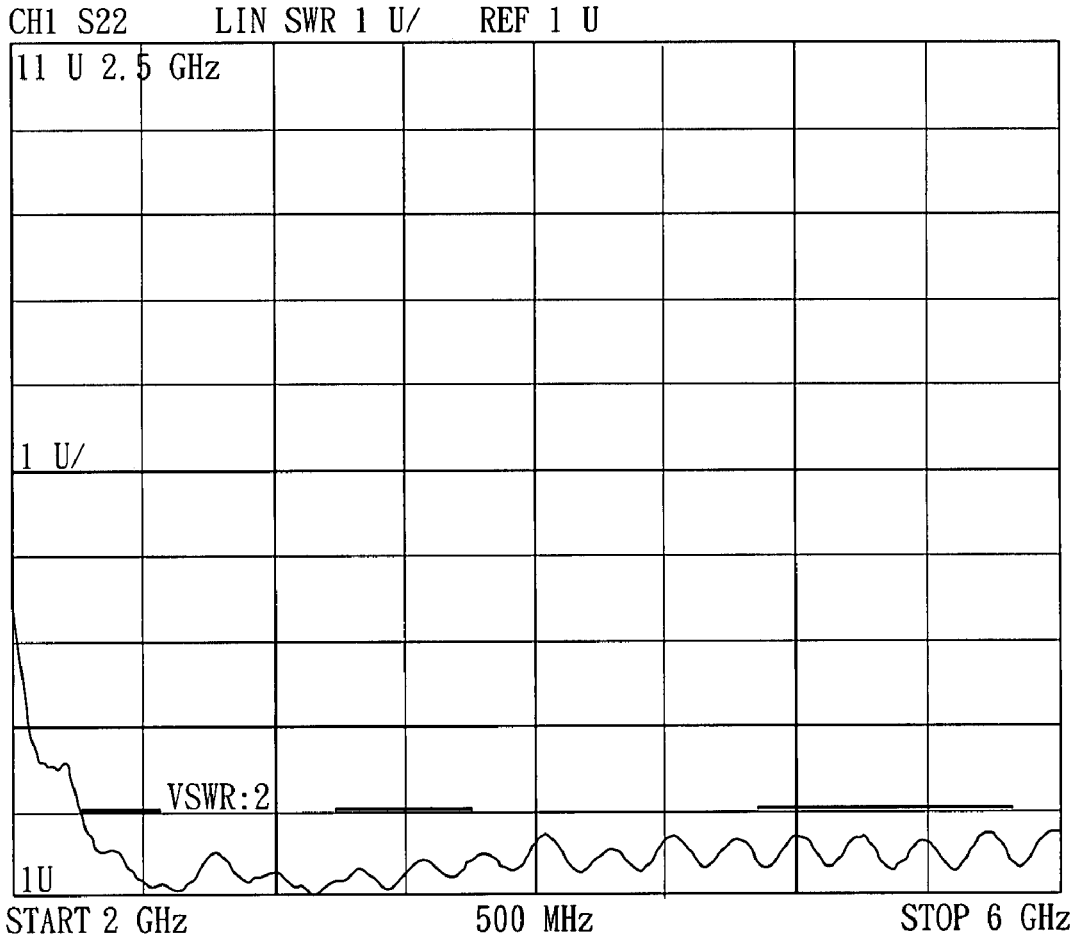
FIG. 3 shows the VSWR for different frequencies according to the multi-frequency antenna shown in FIG. 2.

Please refer to FIG. 3. FIG. 3 shows the VSWR for different frequencies according to the multi-frequency antenna shown in FIG. 2. As shown in FIG. 3, when the frequency range is within 2.3 GHz to 6 GHz, the VSWR of the multi-frequency antenna 10*a* is less than 2. Therefore the multi-frequency antenna 10*a* may transmit signals from 2.3 GHz to 6 GHz. In that way, the multi-frequency antenna 10*a* has the effect of transmitting Wi-Fi and WiMax wireless signals.

Figure 4:
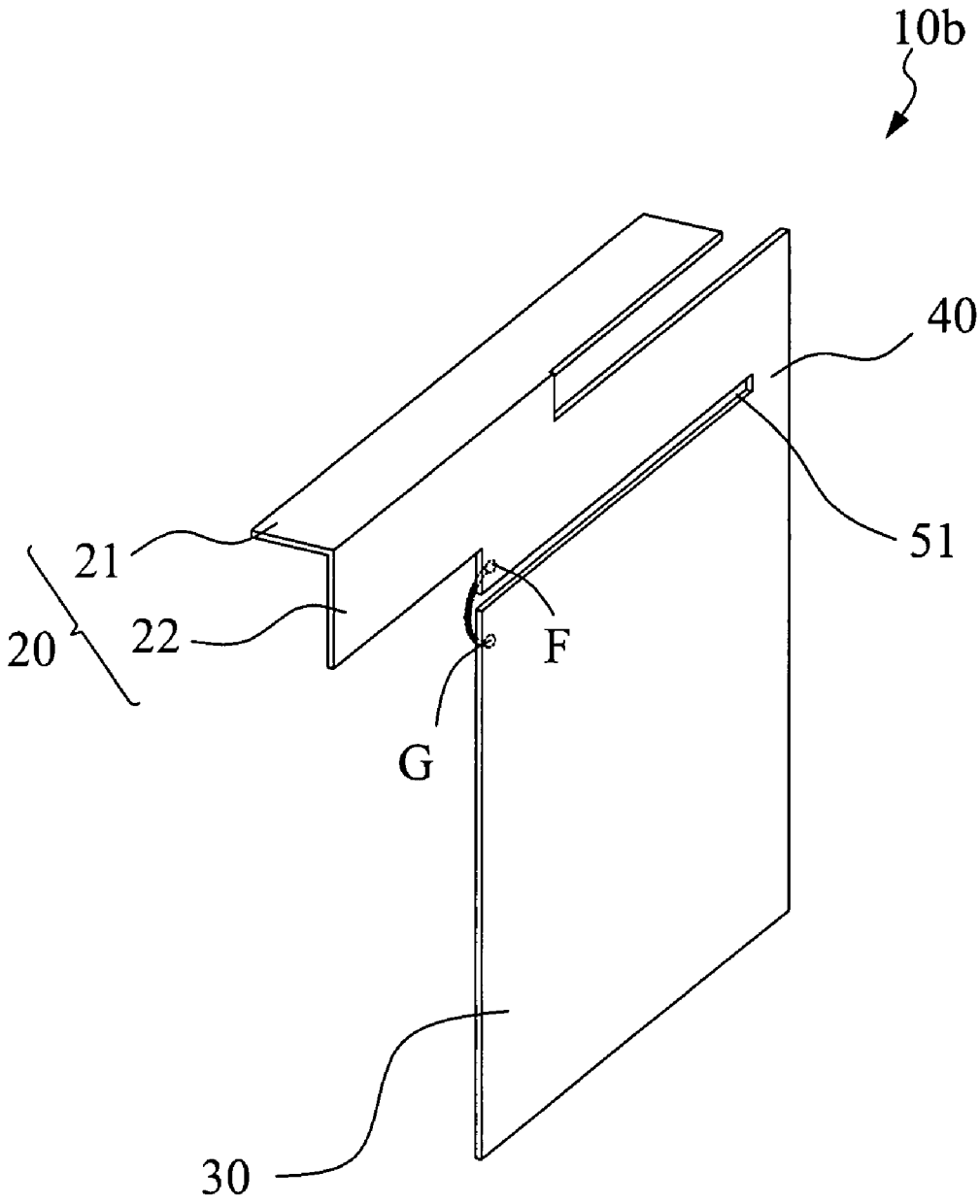
FIG. 4 is a schematic drawing of a multi-frequency antenna according to a second embodiment of the present invention.

The multi-frequency antenna of the invention does not only consist of the structure of the first embodiment in FIG. 2. Please refer to FIG. 4. FIG. 4 is a schematic drawing of a multi-frequency antenna according to a second embodiment of the present invention.

The multi-frequency antenna 10*b* is the simplest design. The radiating element 20 of the multi-frequency antenna 10*b* has only a first radiation area 21 and a second radiation area 22. Furthermore, the grounding element 30 has only a single plane.

Figure 5:
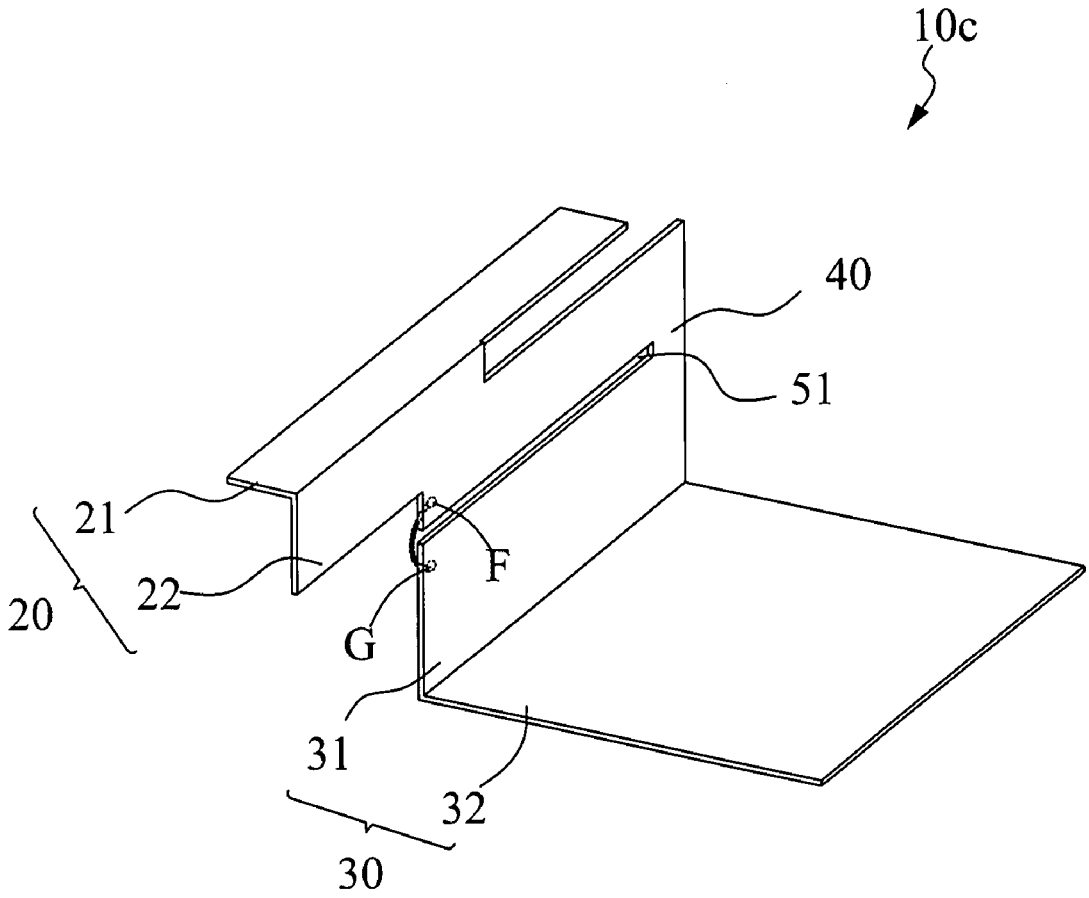
FIG. 5 is a schematic drawing of a multi-frequency antenna according to a third embodiment of the present invention.

Please refer to FIG. 5. FIG. 5 is a schematic drawing of a multi-frequency antenna according to a third embodiment of the present invention. The difference towards multi-frequency antenna 10*b* consists in the fact that the grounding element 30 of multi-frequency antenna 10*c* separates into a first plane 31 and a second plane 32.

Figure 6:
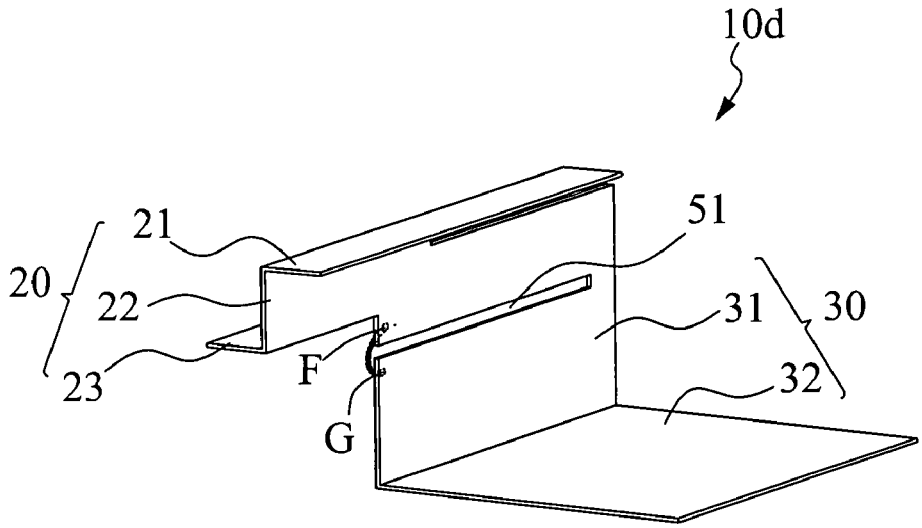
FIG. 6 is a schematic drawing of a multi-frequency antenna according to a fourth embodiment of the present invention.

In the first embodiment of the present invention, the third radiation area 23 and the first radiation area 21 are parallel to each other and are laterally pointing toward the second radiation area 22 in the same direction, but the present invention includes other structures. Please refer to FIG. 6. FIG. 6 is a schematic drawing of a multi-frequency antenna according to a fourth embodiment of the present invention. In this embodiment, the third radiation area 23 and the first radiation area 21 of a multi-frequency antenna 10*d* are laterally pointing away from the second radiation area 22 in the opposite direction.

Figure 7:
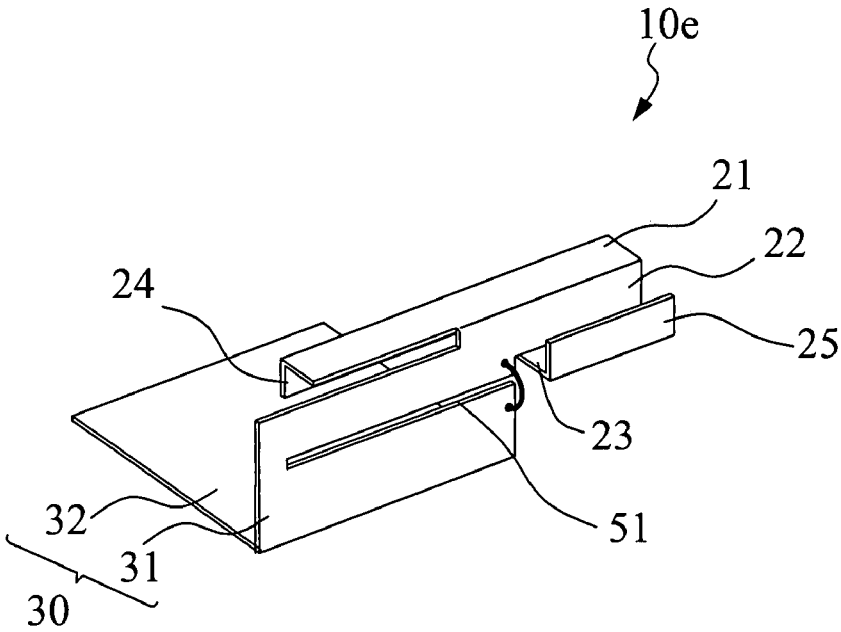
FIG. 7 and FIG. 7A are schematic drawings of a multi-frequency antenna according to a fifth embodiment of the present invention.
Figure 7A:
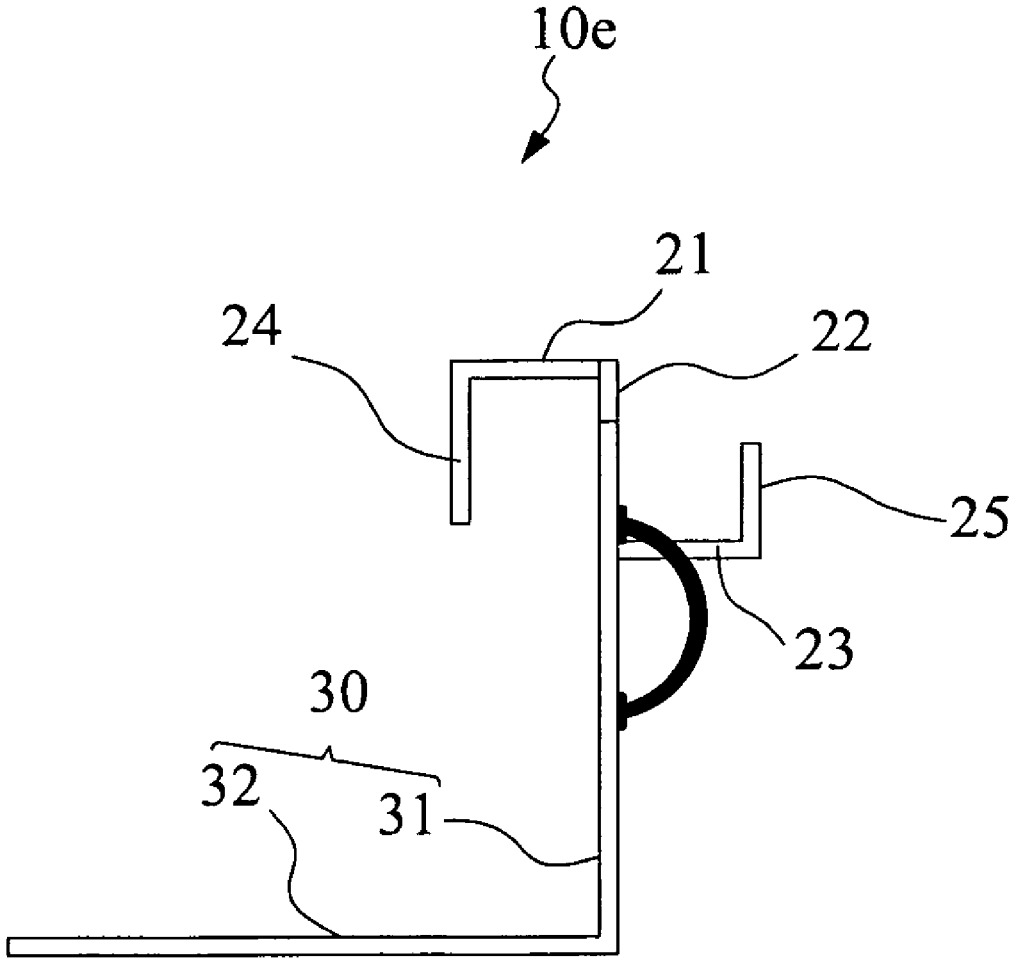

Please refer to FIG. 7 and FIG. 7A. FIG. 7 and FIG. 7A are schematic drawings of a multi-frequency antenna 10*e* according to a fifth embodiment of the present invention. In the fifth embodiment, a fourth radiating area 24 is perpendicularly connected to the first radiation area 21, and a fifth radiation area 25 is perpendicularly connected to the third radiation area 23.

The VSWR figures of above-mentioned embodiments, such as multi-frequency antenna 10*a* and multi-frequency antenna 10*e*, are similar; therefore only the VSWR figure of multi-frequency antenna 10*a* of the first embodiment is shown.

Finally, please refer to FIG. 8. FIG. 8 is a system block diagram of an electric device according to the present invention. The electric device 60 might be a desktop or notebook computer. As shown in FIG. 8, the present invention uses an RF cable (as shown in FIG. 2) to connect the wireless signal module 61 to the multi-frequency antenna 10*a*, or to any of the multi-frequency antennas 10*b* to 10*e* (as shown in FIGS. 4-7). The electric device 60 can thus receive and transmit wireless signals to other devices (not shown) via the multi-frequency antenna 10*a*.

Although the present invention has been explained in relation to its preferred embodiment, it is to be understood that many other possible modifications and variations can be made without departing from the spirit and scope of the invention as hereinafter claimed.

What is claimed is:

1. A multi-frequency antenna comprising:

a radiating element having a first radiation area and a second radiation area, wherein the first radiation area and the second radiation area are perpendicular to each other and located in different planes;

a grounding element;

a connecting element connecting the second radiation area of the radiating element and the grounding element; and a feeding point located on the second radiation area that transmits an electrical signal, wherein the length of the second radiation area is larger than the length of the grounding element.

2. The multi-frequency antenna as claimed in claim 1, wherein between the second radiation area of the radiating element and the grounding element there is a gap.

3. The multi-frequency antenna as claimed in claim 1, wherein the length of the second radiation area is larger than or equal to the length of the first radiation area.

4. The multi-frequency antenna as claimed in claim 1, wherein the radiating element further comprises a third radiation area, the third radiation area being perpendicularly connected to the second radiation area.

5. The multi-frequency antenna as claimed in claim 4, wherein the first radiation area and the third radiation area are pointing toward the same direction or opposite directions.

6. The multi-frequency antenna as claimed in claim 4, wherein a fourth radiation area is perpendicularly connected to the first radiation area, and a fifth radiation area is perpendicularly connected to the third radiation area.

7. The multi-frequency antenna as claimed in claim 1, wherein the grounding element further comprises a first plane and a second plane, the first plane being perpendicularly connected to the second plane.

8. An electric device having a wireless transfer function, the electric device comprising:

a wireless signal module; and a multi-frequency antenna electrically connecting the wireless signal module, the multi-frequency antenna comprising:

a radiating element having a first radiation area and a second radiation area, wherein the first radiation area and the second radiation area are perpendicular to each other and located in different planes;

a grounding element;

a connecting element connecting the second radiation area of the radiating element and the grounding element; and a feeding point located on the second radiation area that transmits an electrical signal, wherein the length of the second radiation area is larger than the length of the grounding element.

9. The electric device as claimed in claim 8, wherein between the second radiation area of the radiating element and the grounding element there is a gap.

10. The electric device as claimed in claim 8, wherein the length of the second radiation area is larger than or equal to the length of the first radiation area.

11. The electric device as claimed in claim 8, wherein the radiating element further comprises a third radiation area, the third radiation area being perpendicularly connected to the second radiation area.

12. The electric device as claimed in claim 11, wherein the first radiation area and the third radiation area are pointing toward the same direction or opposite directions.

13. The electric device as claimed in claim 11, wherein a fourth radiation area is perpendicularly connected to the first radiation area, and a fifth radiation area is perpendicularly connected to the third radiation area.

14. The electric device as claimed in claim 8, wherein the grounding element further comprises a first plane and a second plane, the first plane being perpendicularly connected to the second plane.

* * * * *